US005751207A

United States Patent [19]

Poess

[11] Patent Number: 5,751,207

[45] Date of Patent: May 12, 1998

[54] ANNULAR CORE FOR A CHOKE, IN PARTICULAR FOR RADIO INTERFERENCE SUPPRESSION OF SEMICONDUCTOR CIRCUITS BY THE PHASE CONTROL METHOD

[75] Inventor: Hans-Joachim Poess, Gelnhausen, Germany

[73] Assignee: Vacuumschmelze GmbH, Hanau, Germany

[21] Appl. No.: 813,370

[22] Filed: Mar. 7, 1997

[30] Foreign Application Priority Data

Mar. 7, 1996 [DE] Germany ..... 196 08 890.9

[51] Int. Cl.[6] ..... H01F 27/02; H01F 27/24

[52] U.S. Cl. ..... 336/233; 336/212; 336/213; 336/83

[58] Field of Search ..... 336/100, 83, 212, 336/233, 213

[56] References Cited

U.S. PATENT DOCUMENTS

| | | | |
|---|---|---|---|
| 1,809,042 | 6/1931 | Kelsall | 336/233 |
| 2,467,101 | 4/1949 | Walters | 336/233 |
| 3,781,740 | 12/1973 | Kirmis et al. | 336/96 |
| 4,197,146 | 4/1980 | Frischmann | 148/31.55 |
| 4,272,749 | 6/1981 | Tuji | 336/233 |
| 4,325,096 | 4/1982 | Sunohara et al. | 336/212 |
| 4,789,849 | 12/1988 | Ballard et al. | 336/213 |

OTHER PUBLICATIONS

Patent Abstracts of Japan No. 6 105 1808 (Sadao et al.,) dated Mar. 14, 1986.

*Primary Examiner*—Michael L. Gellner
*Assistant Examiner*—Anh Mai
*Attorney, Agent, or Firm*—Herbert L. Lerner; Laurence A. Greenberg

[57] ABSTRACT

An annular core for a choke, in particular for radio interference suppression of semiconductor circuits by the phase control method, includes two different soft magnetic materials. One material is crystalline and is formed as an annular-core-shaped trough which receives the other material that is in the form of amorphous and/or nanocrystalline particles. The annular core which is thus formed can then be surrounded by a coil, that is connected in series with the consumer by phase control.

5 Claims, 1 Drawing Sheet

ANNULAR CORE FOR A CHOKE, IN PARTICULAR FOR RADIO INTERFERENCE SUPPRESSION OF SEMICONDUCTOR CIRCUITS BY THE PHASE CONTROL METHOD

BACKGROUND OF THE INVENTION

Field of the Invention

The invention relates to an annular core for a choke, in particular for radio interference suppression of semiconductor circuits by the phase control method, including two soft magnetic materials of different permeability and saturation induction.

In order to limit line-conducted high-frequency interference energy, noise suppression chokes are generally used as series members wherever capacitors alone cannot assure adequate low-frequency radio reception. Such chokes are needed particularly for interference suppression of semiconductor circuits that have low internal resistance with respect to radio interference. For instance, they are needed in brightness regulators that function with thyristors. Such chokes should:

effect the requisite interference suppression at the least possible expenditure for filter devices;

not disadvantageously affect the actual function of the circuit, or in other words, for instance, after the conclusion of the switching operation for the load current they should no longer represent any significant ohmic and inductive resistance;

protect the semiconductor against excessively high voltage peaks and an overly steep rise in the making current; and have small dimensions and low scattering.

An annular core choke that meets those requirements is described, for instance, in German Patent DE 18 04 835 C3. That patent proposes using two different soft magnetic metal materials for the annular core of the radio interference suppression choke. The first of those materials has a relatively low permeability with at the same time high saturation induction, while the second material has medium permeability.

It is also known from German Published, Prosecuted Patent Application DE 23 43 377 B2 for the core of a radio interference suppression choke to use sheet-metal rings as well as a powder core that is formed of iron powder, compacted with plastic. The part of the assembled choke core that is formed of iron powder compacted with plastic serves as a material of lesser permeability, since the plastic binder between the iron particles functions magnetically like individual air gaps.

In the case of magnetic cores that are formed of compacted soft magnetic powder, amorphous powder or nanocrystalline powder has also already been used. That is disclosed in Published European Patent Application 0 302 355 A1. However, despite the substantially higher permeability of the amorphous material and in particular of the nanocrystalline material, once again a powder core, because of the binder being used, will have a lower permeability than solid cores, even if the latter are made of crystalline material.

SUMMARY OF THE INVENTION

It is accordingly an object of the invention to provide an annular core for a choke, in particular for radio interference suppression of semiconductor circuits by the phase control method, which overcomes the hereinafore-mentioned disadvantages of the heretofore-known devices of this general type, which can be produced simply and economically and which can be produced in very compact choke sizes, depending on the power or capacity, by utilizing the high permeability of amorphous or nanocrystalline alloys.

With the foregoing and other objects in view there is provided, in accordance with the invention, an annular core for a choke, in particular for radio interference suppression of semiconductor circuits by the phase control method, comprising an annular-core-shaped trough formed of a soft magnetic crystalline material having a given permeability and saturation induction, the trough having an interior; and amorphous and/or nanocrystalline particles in the form of powder or flakes disposed in the interior of the trough, the particles formed of a soft magnetic material having a permeability and saturation induction different from the given permeability and saturation induction.

In accordance with another feature of the invention, the trough of crystalline soft magnetic material may be made of any arbitrary soft magnetic alloy. Advantageously, however, pure iron is used.

Comminuted strips of amorphous or nanocrystalline material can be used as the powder or flakes. However, it is also possible to use the material that is involved in producing the strips but is unusable for strips, for instance because of brittleness or poor dimensional stability, etc., and would otherwise have to be melted down again as scrap.

In accordance with a further feature of the invention, there is provided a cap which is also made of soft magnetic material or plastic and serves to close the trough, so that the nanocrystalline particles are enclosed on all sides and require no compacting.

In accordance with a concomitant feature of the invention, it is nevertheless possible to improve the fill factor by press-fitting the particles, or to attain additional noise abatement by adding a binder to the trough.

Other features which are considered as characteristic for the invention are set forth in the appended claims.

Although the invention is illustrated and described herein as embodied in an annular core for a choke, in particular for radio interference suppression of semiconductor circuits by the phase control method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
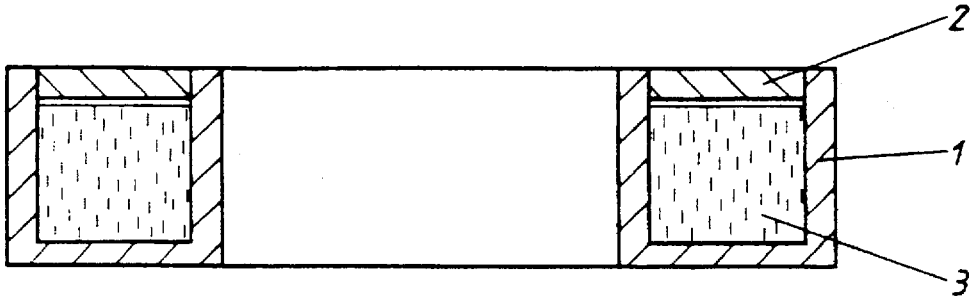
FIG. 1 is a diagrammatic, cross-sectional view of one exemplary embodiment of the invention.

Referring now to the figures of the drawings in detail, and first, particularly, to FIG. 1 thereof, there is seen an annular-core-shaped trough 1, which may be covered by a cap 2 and in which there are amorphous and/or nanocrystalline particles 3 that largely fill up the interior of the trough 1. The trough 1 with the particles 3 of nanocrystalline or amorphous material located therein can be provided with insulation in the usual way and be used as an annular core for a choke. The structure according to the invention is advantageous, particularly for radio interference suppression chokes, since the high permeability of the particles of amorphous or nanocrystalline material have small dimensions but assure high inductance, and since eddy currents that develop in the trough 1 contribute to damping the current. For this reason, the core is especially suitable for chokes that are used for radio interference suppression of semiconductor circuits that operate by the phase control method and generate harmonics in the operating current.

Figure 2:
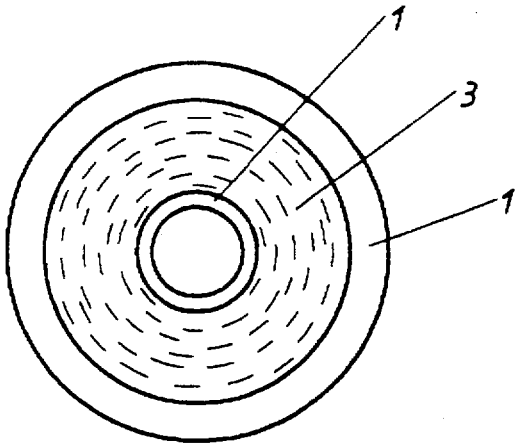
FIG. 2 is a plan view of the embodiment shown in FIG. 1.

FIG. 2 shows a plan view on the annular core shown in cross section in FIG. 1, in which the trough 1 is shown without a cap but with the particles 3 located in the interior of the trough. The trough 1 in this case can be entirely or merely partly formed of soft magnetic material, depending on what amount of eddy currents is desired for the particular intended application. The eddy currents that develop can also be adapted to given requirements by choosing the wall thickness of the trough.

I claim:

1. An annular core for a choke, in particular for radio interference suppression of semiconductor circuits by the phase control method, comprising:

an annular-core-shaped trough formed of a soft magnetic crystalline material having a given permeability and saturation induction, said trough having an interior; and at least one of amorphous and nanocrystalline particles in the form of powder or flakes disposed in said interior of said trough, said particles formed of a soft magnetic material having a permeability and saturation induction different from said given permeability and saturation induction.

2. The annular core according to claim 1, including a cap constructed as an annular-core-shaped disk closing said annular-core-shaped trough.

3. The annular core according to claim 2, wherein at least one of said annular-core-shaped trough and said cap is formed of pure iron.

4. The annular core according to claim 2, wherein said cap closing said annular-core-shaped trough is formed of plastic.

5. The annular core according to claim 1, including a binder holding said particles together in said trough.

* * * * *